US007097223B1

(12) United States Patent
Bradford

(10) Patent No.: US 7,097,223 B1
(45) Date of Patent: Aug. 29, 2006

(54) SHOPPING BAG HANDLE

(76) Inventor: Mark P. Bradford, 2874 Duane Plz., Apt. G., Bellevue, NE (US) 68123

( * ) Notice: Subject to any disclaimer, the term of this patent is extended or adjusted under 35 U.S.C. 154(b) by 0 days.

(21) Appl. No.: 10/422,887

(22) Filed: Apr. 24, 2003

(51) Int. Cl.
*B65D 33/06* (2006.01)

(52) U.S. Cl. ..... 294/137; 294/158

(58) Field of Classification Search ..... 294/137, 294/148, 153, 158; 119/801; 24/599.1; D9/434

See application file for complete search history.

(56) References Cited

U.S. PATENT DOCUMENTS

| | | | | | |
|---|---|---|---|---|---|
| 4,004,722 | A | | 1/1977 | Olivier | 224/45 P |
| 4,045,067 | A | * | 8/1977 | Wieder et al. | 294/137 |
| 4,095,316 | A | * | 6/1978 | Gabriel | 24/599.1 |
| 4,112,541 | A | * | 9/1978 | Tetradis | 294/137 |
| 4,772,059 | A | | 9/1988 | Parry et al. | 294/170 |
| 4,824,156 | A | * | 4/1989 | Greene | 294/137 |
| 5,150,938 | A | | 9/1992 | Gans | 294/156 |
| 5,263,755 | A | | 11/1993 | Thompson | 294/165 |
| 5,433,494 | A | | 7/1995 | Du Buisson | 294/165 |
| 5,441,323 | A | * | 8/1995 | Goddard | 294/158 |
| 5,599,052 | A | | 2/1997 | Van Davelaar | 294/159 |
| 5,645,306 | A | | 7/1997 | Kosteniuk | 294/137 |
| 5,651,575 | A | | 7/1997 | Bystrom et al. | 294/171 |
| D386,682 | S | * | 11/1997 | Richardson et al. | D9/434 |
| 5,697,661 | A | | 12/1997 | Robinson, Sr. et al. | 294/142 |
| 5,797,166 | A | | 8/1998 | Wagenheim | 16/124 |
| 5,836,634 | A | | 11/1998 | Finkelman | 294/159 |
| 5,855,403 | A | | 1/1999 | Harper | 294/158 |
| 5,904,388 | A | | 5/1999 | Seibel | 294/163 |
| 5,921,601 | A | * | 7/1999 | Buckles | 294/142 |
| 6,062,622 | A | | 5/2000 | Susman | 294/149 |
| 6,347,822 | B1 | | 2/2002 | Miller, Jr. | 294/158 |
| 6,511,114 | B1 | | 1/2003 | Fludd | 294/159 |
| 6,688,259 | B1 | * | 2/2004 | Axel | 119/792 |
| 2002/0179023 | A1 | * | 12/2002 | Axel | 119/801 |

FOREIGN PATENT DOCUMENTS

| | | | | |
|---|---|---|---|---|
| FR | 380553 | * | 12/1907 | 294/137 |
| FR | 2659626 | * | 9/1991 | 294/137 |

* cited by examiner

*Primary Examiner*—Eileen D. Lillis
*Assistant Examiner*—Paul T. Chin
(74) *Attorney, Agent, or Firm*—Thomte, Mazour & Niebergall; Shane M. Niebergall

(57) ABSTRACT

A device for carrying articles having handles is provided with generally elongated gripping and handle supporting members that are positioned in spaced-apart relationship with one another. A retaining assembly is pivotably coupled to the gripping member which can be moved between open and closed positions using the same hand that carries the device. Multiple embodiments are provided for the selective securement of the retaining assembly in its closed and/or open positions. The design of the device lends itself to durable but simple construction.

12 Claims, 3 Drawing Sheets

SHOPPING BAG HANDLE

BACKGROUND OF THE INVENTION

The present invention relates to a device for carrying articles with handles and more particularly to a handle assembly capable of carrying a plurality of shopping bags that is fully operable with a single hand.

DESCRIPTION OF THE PRIOR ART

Supermarkets and retailers use a number of different types of bags to assist the consumer in transporting the purchased goods from the store to the consumer's home. Many of these shopping bags are provided with handle members at the top of the bag for ease in carrying the same. The shopping bags tend to be small in nature, which promotes the desire for the consumer to carry several shopping bags in each hand when traveling from the store to the consumer's car or from the consumer's car into their home. However, as the number of bags carried within one hand increases, along with the varied weight of the goods within the bags, the load becomes increasingly uncomfortable and difficult to carry by the consumer. This typically necessitates multiple trips.

Several devices have been developed to assist the consumers in transporting their bagged goods. U.S. Pat. No. 5,855,403 discloses a bag carrying device having elongated, spaced-apart upper and lower portions and a separate carrying handle extending from the upper portion. A resiliently deformable tab member extends between the upper and lower portions of the device in an attempt to retain the articles in the carrying device. While such a device is certainly beneficial in overcoming a number of the difficulties encountered in carrying a plurality of shopping bags, such a design suffers from the inconvenience of being incapable of single-handed operation. The prior art patent discloses no apparent manner of carrying the device by its handle while simultaneously actuating the resilient tab member to engage and release the articles. Accordingly, the user must use both hands to load the articles onto the device and then use both hands to unload the articles. When an individual is using two devices, these additional steps double. Moreover, the resiliently deflectable tab is dependent upon the flexibility from which the handle is formed to provide its available movement. This limits the range of movement of the tab, limits the usable life of the tab's deflection points, and fails to provide any manner of stably securing the tab in a closed or open position.

U.S. Pat. No. 5,904,388 discloses another bag carrying device having elongated upper and lower members that are spaced apart from one another. The device is further provided with a latch and hook assembly to retain the articles within the device. The lower portion of the device is provided with a plurality of recesses to receive the handles extending from the articles. However, this device, while adding numerous bells and whistles, suffers from the same deficiencies as the other prior art devices. Nowhere is the device described as being capable of being carried while simultaneously actuating the latch and hook mechanism with the hand that is carrying the device. Moreover, the arrangement of the articles among the various recesses also necessitates the use of a second hand to properly arrange the same.

Similarly, U.S. Pat. No. 5,263,755 discloses a bag carrying device that is generally D-shaped, having a hinged lower receiving member that supports the bags in the carrying position. To secure the lower receiving member in position, a pin member extends through the handle and is selectively engageable with the free hand of the lower member. Again, however, this system is incapable of single-handed operation. Moreover, if the lower retaining member were disengaged while the articles were being carried, the entire carrying device would open up and release all of the articles indiscriminately. The curved nature of the lower retaining member further provides for a difficult distribution of the weight of the articles when they are loaded into the device.

U.S. Pat. No. 5,433,494 discloses a handle device having recesses disposed at the opposite ends of a gripping member. The recesses are selectively closed using a slidable, horizontally disposed pin member. However, such a device is plagued with the problem of even weight distribution, much like the common teeter-totter. Moreover, due to the fact that the sliding retaining members are positioned at the opposite ends of the handle, the device is not conveniently operable with a single hand while the device is being carried.

Accordingly, what is needed is a novel device for carrying articles that is simultaneously operable and carryable with a single hand.

SUMMARY OF THE INVENTION

The device for carrying articles of the present invention is provided with elongated upper and lower members that are positioned in a generally parallel spaced-apart relationship with one another. The space between the upper and lower members provides a recess in which the handles of shopping bags or other articles can be received. A retaining member is pivotably coupled to the forward end of the upper member and selectively moves between open and closed positions with respect to the lower member.

In use, the device can be carried by the upper member while the user simultaneously pivots the retaining member into its open position to receive the shopping bag handles. The user then, with the same hand, closes the retaining member and transports the shopping bags accordingly. At the user's final destination, the retaining member can be pivoted to its open position with the same hand that is carrying the device so that the shopping bags can be selectively released from the device. Accordingly, the device enables a user to use separate devices in the user's right and left hand to quickly and efficiently collect, transport, and release a plurality of shopping bags.

A ratchet and pawl system is provided adjacent the pivot connection between the retaining member and the upper member to selectively retain the retaining member in its closed or open positions. A spring member is optionally coupled to the ratchet and pawl assembly to conveniently bias the retaining member to its open position when the user actuates the pawl. A retaining lip is optionally provided at the free end of the retaining member to operatively engage a recess formed in the free end of the lower member to secure the retaining member in its closed position. The lip and recess assembly can be used in conjunction with or apart from the ratchet and pawl assembly.

It is therefore a principal objection of the present invention to provide a device for carrying articles having an article retaining assembly that can be actuated while the device is being carried by the same hand carrying the device.

A further object of the present invention is to provide a device for carrying articles having a retaining assembly that is selectively lockable in open and/or closed positions.

Still another object of the present invention is to provide a device for carrying articles having an article retaining assembly that is easily operable with a single hand.

Yet another object of the present invention is to provide a device for carrying articles having an article retaining assembly that is provided with multiple methods of securing the retaining assembly in a closed position.

Still another object of the present invention is to provide a device for carrying articles that is durable yet simple to manufacture.

These and other objects will be apparent to those skilled in the art.

DESCRIPTION OF THE PREFERRED EMBODIMENT

Figure 1:
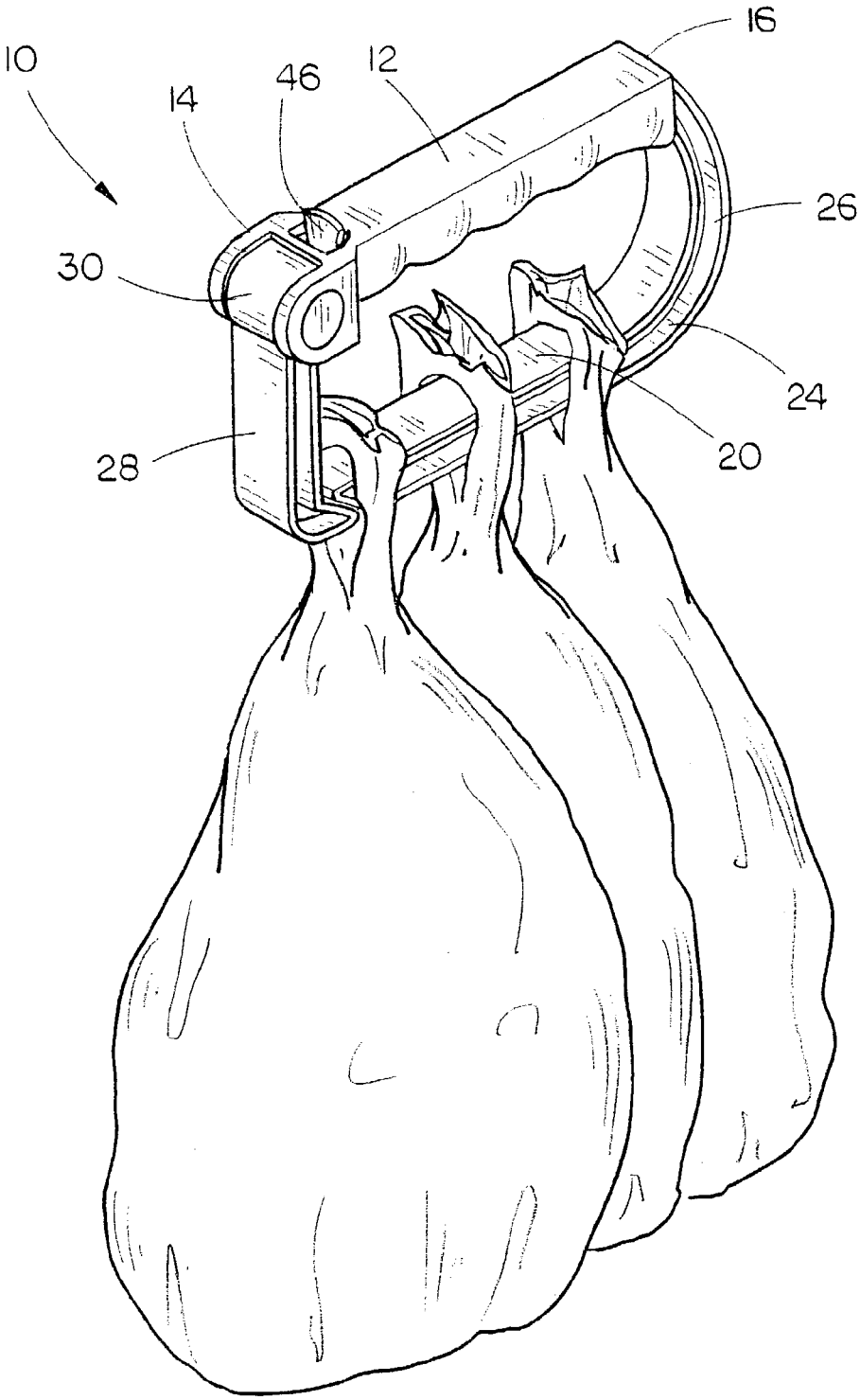
FIG. 1 is a perspective view of an embodiment of the device of the present invention as the same might be used to carry articles.
Figure 2:
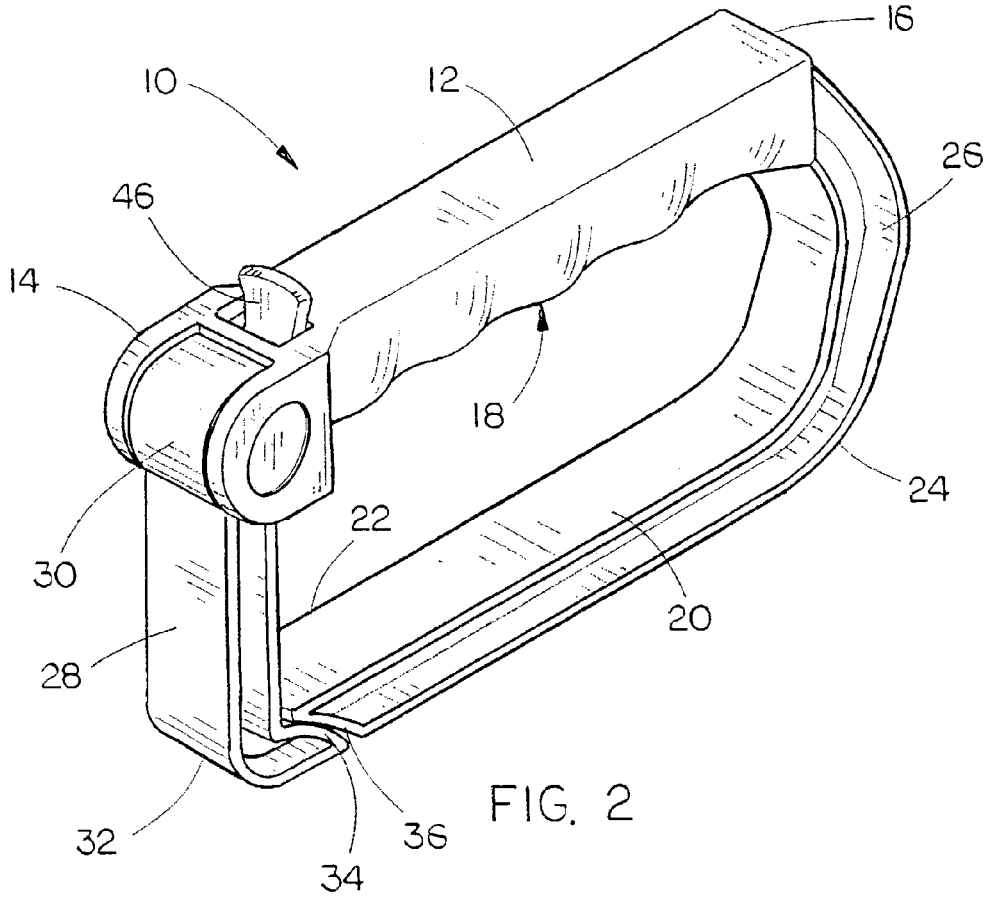
FIG. 2 is a perspective view of the device for carrying articles of the present invention.
Figure 3:
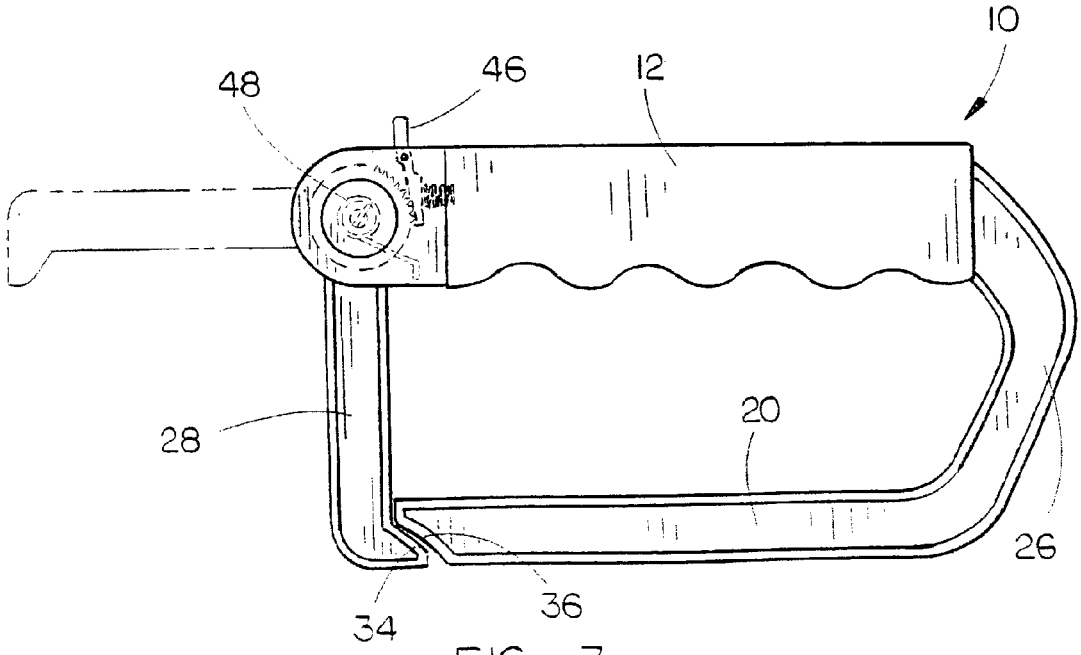
FIG. 3 is a side elevation view of the device of FIG. 1 further depicting an embodiment of the article retaining assembly.
Figure 4:
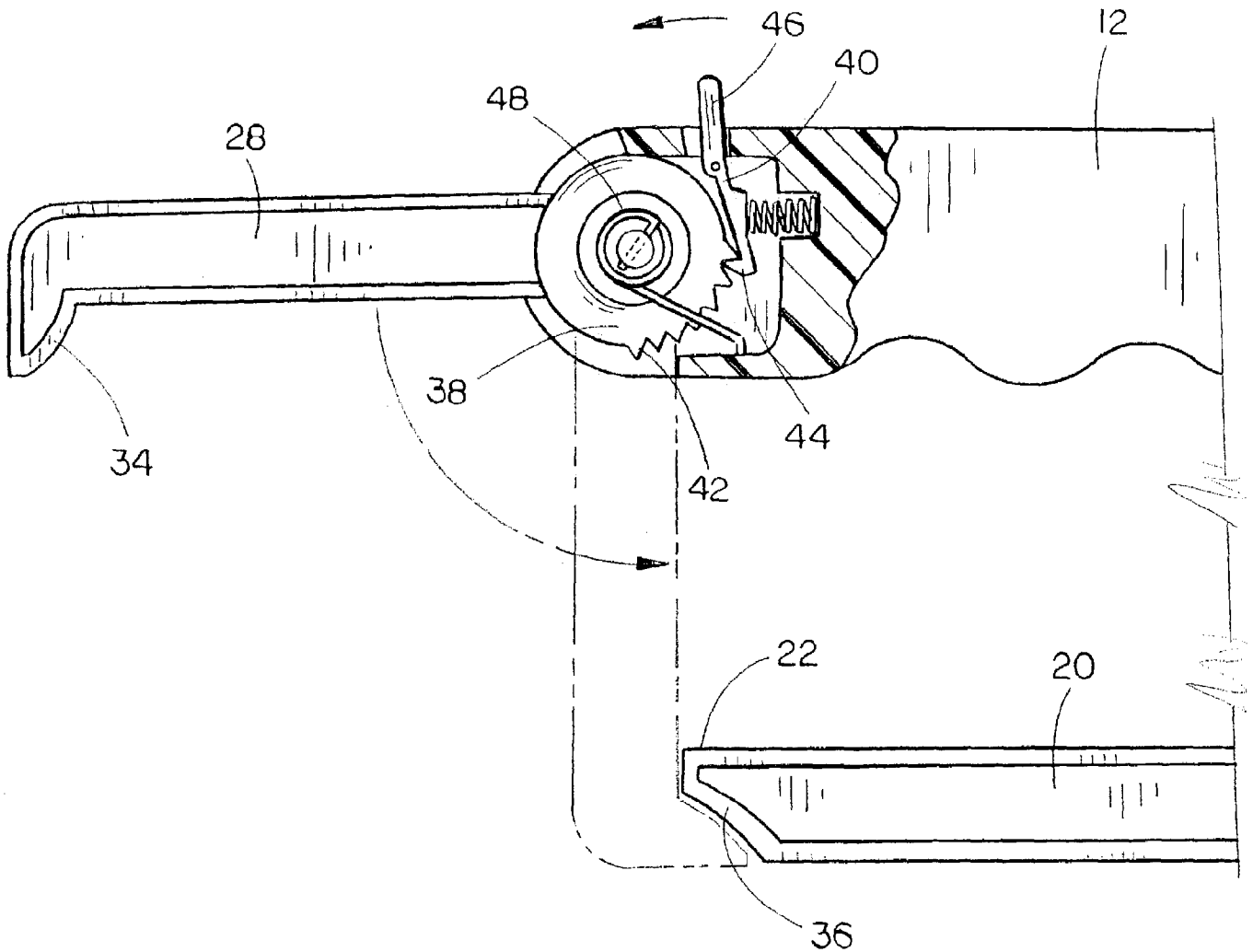
FIG. 4 is a partial cutaway view of one embodiment of a method of securing the retaining assembly of the present invention.

The numeral 10 refers generally to the shopping bag handle of the present invention, as depicted in FIGS. 1–3. The shopping bag handle is generally provided with an elongated gripping member 12 having a forward end portion 14 and a rearward end portion 16. The gripping member 12 is further preferably provided with a lower surface portion 18 having a shape that substantially conforms to the hand of a user. It is contemplated that the shape of the lower surface 18 could be curved or generally parabolic-shaped, as shown in FIG. 1. It is further contemplated that individual recesses could be formed in the lower surface 18 for the proper location of the user's fingers. To further provide for the comfort of the user, the gripping member 12 could be provided with a layer of deformably resilient material, such as rubber, foam rubber, or other synthetic version thereof, such as Neoprene.

The shopping bag handle 10 is further provided with an elongated support member 20 having a forward end portion 22 and a rearward end portion 24. The support member 20 is preferably positioned in a spaced relationship to the gripping member 12, as shown in FIG. 1. It is preferred, although not crucial, that the support member 20 be generally parallel to the gripping member 18. The rearward end portion 24 preferably extends upwardly towards and connects with the rearward end portion 16 of the gripping member 12 to form a rearward side member 26 of the shopping bag handle 10. However, it is contemplated that a separate structure could be provided for coupling the gripping member 12 to the support member 20 at their respective rearward end portions 16 and 24.

It is contemplated that the gripping member 12 and support member 20 could be formed from nearly any material such as wood, metal or plastic. However, it is preferred for the cost and practicality of manufacture that the component parts be manufactured from plastic. As can be seen in FIG. 1, support member 20 may be optionally formed to have an I-shaped cross section to provide an improved strength to weight ratio over other comparable designs. However, it is contemplated that the support member 20 could be formed as a hollow tube-shaped member or from a solid material in nearly any shape that is commercially feasible.

A retaining assembly is preferably provided to the shopping bag handle 10, comprising at least a retaining member 28 having an upper end portion 30 and a lower end portion 32. The upper end portion 30 of the retaining member 28 is preferably pivotably coupled to the forward end portion 14 of the gripping member 12 so that the retaining member 28 is selectively movable between open and closed positions, as shown in FIG. 2. The retaining member 28 preferably has a length sufficient to position its lower end 32 closely adjacent the forward end portion 22 of the support member 20. Optionally, the lower end portion 32 of the retaining member 28 can be provided with a lip 34 that extends rearwardly from the lower end portion 32. In that instance, the forward end portion 22 of the support member 20 should be shaped with a recess portion 36 to closely engage the lip 34 when the retaining member 28 is in its closed position. The lip 34 and recess 36 can provide frictional engagement between one another to provide a method of selectively securing the retaining member 28 in its closed position when the shopping bag handle 10 is in use. Although virtually any shape of lip and recess would function for this purpose, the rounded lip 34 and cove-shaped recess 36 allow retaining member 28 to provide an element of structural support to the shopping bag handle 10 when a heavy load is secured on the support member 20.

Another method of securing the retaining member 28 in a particular open or closed position is provided by a ratchet 38 and pawl 40, which are shown in greater detail in FIG. 3. Although the ratchet 38 is depicted as having individual teeth 42 extending radially therefrom, it is contemplated that a plurality of recesses or grooves could also be formed within the ratchet 38. The pawl 40 is preferably provided with an engagement end 44 and an actuation end 46. The engagement end 44 is preferably shaped to securely engage the surface features of the ratchet 38. The actuation end 46 is preferably positioned to extend outwardly from and slightly above the gripping member 12 in a position conveniently adjacent the user's thumb. The pawl 40 is pivotably coupled to the forward end 14 of the gripping member 12 closely adjacent the ratchet 38, located on the upper end portion 30 of the retaining member 28. Accordingly, the user is able to disengage the pawl 40 from the ratchet 38 to position the retaining member 28 in an open or closed position, as desired. The user may then engage the pawl member 40 to secure the retaining member 28 in that position. A spring member 48 can optionally be secured coaxially with the pivot point of the retaining member 28 to bias the retaining member 28 toward its open position. Accordingly, when the spring member 28 is used, the user is able to selectively disengage the pawl 40 from the ratchet 38 so that the retaining member 28 extends automatically from a closed position to an open position.

In the open position, the handles of the articles or shopping bags can be "threaded" onto the support member 20. The retaining member 28 can then be moved to its closed position through forward engagement of the upper end portion 30 of the retaining member 28 by the user's thumb until the desired closed position is achieved. It is further contemplated that the user's index finger could be engaged with the side of the retaining member 28 and pulled rearwardly and downwardly in a trigger-pulling fashion. Once the user has reached the delivery destination for the shopping bags or articles being carried, the user simply disengages the pawl 40 from the ratchet 38 to raise the retaining member 28 and slide the shopping bag handle 10 in a rearward direction until the handles of the shopping bags or articles are free of the support member 20. Where the ratchet and pawl system is not used, the user would engage the retaining member 28 with the user's thumb or finger in the reverse fashion to that described hereinabove.

The simple actuation of the retaining assembly using the thumb or fingers of the user's hand that is carrying the shopping bag handle 10 allows the system to be simply used in a one-handed fashion. This permits the user to use a shopping bag handle 10 in each of the user's right and left hands to carry twice the load at the same time. The ability to capture and release shopping bags or articles with a single hand provides a greatly improved convenience and efficiency to the prior art.

In the drawings and in the specification, there have been set forth preferred embodiments of the invention; and although specific items are employed, these are used in a generic and descriptive sense only and not for purposes of limitation. Changes in the form and proportion of parts, as well as substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A device for carrying articles, comprising:

an elongated gripping member having forward and rearward end portions;

an elongated support member having forward and rearward end portions; said rearward end portion of said support member being operatively coupled to the rearward end portion of said gripping member so that said support member and said gripping member are disposed in a spaced-apart relationship with one another; and an elongated retaining member having upper and lower end portions; said upper end portion of said retaining member being operatively coupled to the forward end portion of said gripping member; said retaining member having a lip member that extends outwardly from said lower end portion in a generally perpendicular fashion, so as to provide said retaining member with an L-shape; said lip member being operatively selectively engageable with the forward end portion of said support member;

said retaining member being selectively pivotable between open and closed positions with respect to said forward end portion of said support member;

said retaining member being positioned relative to said gripping member to enable a user to simultaneously grip said gripping member and selectively move said retaining member between said open and closed positions with a single hand.

2. The device of claim 1 further comprising a recess formed in the forward end portion of said support member to releasably engage the lip member of said retaining member.

3. The device of claim 1 wherein said gripping member is shaped to generally conform with a user's hand.

4. The device of claim 1 further comprising an outer layer of resiliently deformable material on said gripping member.

5. The device of claim 1 wherein said gripping member and said support member are generally parallel with one another.

6. A device for carrying articles, comprising:

an elongated gripping member having forward and rearward end portions;

an elongated support member having forward and rearward end portions; said rearward end portion of said support member being operatively coupled to the rearward end portion of said gripping member so that said support member and said gripping member are disposed in a spaced-apart relationship with one another;

an elongated retaining member having upper and lower end portions; said upper end portion of said retaining member being operatively coupled to the forward end portion of said gripping member; said lower end portion of said retaining member being operatively selectively engageable with the forward end portion of said support member;

said retaining member being selectively pivotable between open and closed positions with respect to said forward end portion of said support member;

said retaining member being positioned relative to said gripping member to enable a user to simultaneously grip said gripping member and selectively move said retaining member between said open and closed positions with a single hand; and a pawl member, having first and second end portions, operatively coupled to the forward end portion of said gripping member adjacent the upper end portion of said retaining member; said pawl member being selectively engageable with the upper end portion of said retaining member to prevent movement of said retaining member toward said open position.

7. The device of claim 6 further comprising a plurality of ratchet teeth extending outwardly from the upper end portion of said retaining member such that said ratchet teeth may be selectively engaged by said pawl.

8. The device of claim 7 further comprising a spring member operatively coupled to the upper end portion of said retaining member to bias said retaining member toward said open position.

9. The device of claim 8 wherein the first end portion of said pawl is adapted for selective manual engagement to release said pawl from engagement with said ratchet teeth and allow said releasing member to automatically move to said open position.

10. The device of claim 6 wherein said gripping member is shaped to generally conform with a user's hand.

11. The device of claim 6 further comprising an outer layer of resiliently deformable material on said gripping member.

12. The device of claim 6 wherein said gripping member and said supporting member are disposed in a generally parallel, spaced-apart relationship to one another.

* * * * *